United States Patent [19]

Schjelde et al.

[11] 4,115,039

[45] Sep. 19, 1978

[54] RESILIENT PRESSURE TUBE

[75] Inventors: Ole Mikel Schjelde; Ebbe Larsen, both of Sonderborg, Denmark

[73] Assignee: Danfoss A/S, Nordborg, Denmark

[21] Appl. No.: 786,423

[22] Filed: Apr. 11, 1977

[30] Foreign Application Priority Data

Apr. 21, 1976 [DE] Fed. Rep. of Germany ..... 2617387

[51] Int. Cl.[2] ..... F14B 39/12; F16F 15/02

[52] U.S. Cl. ..... 417/363

[58] Field of Search ..... 417/363, 902, 415; 62/295, 296

[56] References Cited

U.S. PATENT DOCUMENTS

| | | | |
|---|---|---|---|
| 3,089,639 | 5/1963 | Hannibal | 62/295 |
| 3,187,991 | 6/1965 | Roelsgaard | 417/363 |
| 3,187,992 | 6/1965 | Roelsgaard | 417/363 |
| 3,361,339 | 1/1968 | Nagare | 417/902 X |
| 3,461,683 | 8/1969 | Valbjorn et al. | 417/902 X |
| 3,790,308 | 2/1974 | Romer et al. | 417/363 |
| 3,849,028 | 11/1974 | Kurits et al. | 417/363 |

FOREIGN PATENT DOCUMENTS

| | | | |
|---|---|---|---|
| 936,630 | 9/1963 | United Kingdom | 417/415 |

*Primary Examiner*—Carlton R. Croyle
*Assistant Examiner*—Richard E. Gluck
*Attorney, Agent, or Firm*—Wayne B. Easton

[57] ABSTRACT

The invention relates to refrigeration apparatus of the type in which a motor-compressor unit is resiliently mounted in a sealed casing. A resilient refrigerant discharge tube extends from the compressor to an outlet port in the casing. The discharge tube is made resilient to prevent noise and vibrations from being transmitted outwardly to the casing. The discharge tube has at least two convolutions in intersecting planes which are preferably at right angles to each other and are generally vertically disposed to form angles of less than 45 degrees relative to the vertical motor axis. The convolutions are preferably rectangularly shaped.

4 Claims, 4 Drawing Figures

RESILIENT PRESSURE TUBE

The invention relates to a resilient pressure tube for motor compressors of refrigerators resiliently held in a capsule, particularly with a vertical motor axis and the compressor disposed at the top, comprising at least two convolutions.

Such pressure tubes serve to lead the compressed refrigerant from the compressor, through the interior of the capsule which is under vacuum, towards the outside. The pressure tube, which is usually of steel, forms a spring. It is desired that this spring be as soft as possible so that vibrations and sounds of the motor compressor are not transmitted to the wall of the capsule. It is particularly annoying if the pressure tube spring together with the mass of the motor compressor and possibly other elements has an inherent frequency which coincides with some operating frequency of the motor compressor, such as the motor frequency, because sounds are then transmitted in an amplified form.

For a pressure tube in the form of a substantially cylindrical coil with two or more convolutions, it is known to arrange it so that its axis is coincident with the motor axis. In another very common type of installation, the pressure tube is bent to a sinuous form and the sinuous strip thus formed is adapted to the curvature of the capsule. However, in both cases a considerable amount of noise is still transmitted from the motor compressor to the wall of the capsule through the pressure tube, particularly during starting and stopping but also during operation. Although these sounds can be reduced by making the pressure tube longer, only a limited amount of space is available in the capsule.

The invention is based on the problem of providing a pressure tube of the aforementioned kind with which the transmission of sounds can be reduced still further.

This problem is solved according to the invention in that the plane of at least one convolution is at an angle to the plane of at least a second convolution.

Since the convolutions are generally not accurately disposed in one plane surface, the 'plane' of a convolution is intended to mean that planar surface which is best adapted to the convolution. This applies to a surface for which the integral of the square of the spacing between the surface and the convolution is a minimum. For a helical convolution, this surface is perpendicular to the axis of the helix. The term 'convolution' includes those shapes which, when projected onto the plane of the convolution, do not result in a complete loop but only a loop that is closed by more than 75%.

Such a construction is based on the consideration that the oscillations transmitted to the pressure tube from the motor compressor have very different spatial directions and that the pressure tube exhibits a very different spring behaviour in the directions of the three coordinates. The convolutions of a pressure tube are less stiff perpendicular to their plane than they are in their plane. If one provides two convolutions having planes at an angle to one another, two principal directions are produced in which the spring is sufficiently soft. There is no difficulty in locating these principal directions so that they take due account of the directions of the principal oscillations. In a motor compressor, these are the coordinates extending perpendicular to the motor axis.

The best possible effect is achieved if the planes of two convolutions are substantially at right-angles to each other.

It is of particular advantage for the convolutions to be substantially rectangular. It is particularly favourable if the pressure tube consists predominantly of rectilinear tube sections. In comparison with curved tube sections, straight sections have the advantage that they have the same spring properties in all directions perpendicular to its length. Each rectilinear tube section therefore contributes to the softness not only in one coordinate but also in a coordinate perpendicular thereto. With two rectangular convolutions extending substantially at right-angles to one another one therefore obtains a pressure tube spring which is sufficiently soft in all three directions of the coordinates. This softness can even be achieved with pressure tubes that are shorter than known tubes.

Further, it is advantageous if the planes of the convolutions are at an angle of less than 45° to the motor axis. In this way, account is taken of the most intense oscillations which primarily occur at right-angles to the motor axis. The best effect is obtained if the plane of at least one convolution extends substantially parallel to the motor axis. However, if oscillations in the direction of the motor axis are also to be taken into account, any angle up to 45° can be selected, it being recommended that the plane of at least one convolution should intersect the motor axis at an angle of about 20° to 30°. A pressure tube that is soft all round is obtained if two substantially rectangular convolutions with their planes at right-angles to one another are used, of which the one extends parallel to the motor axis and the other at an angle of about 30° thereto.

Further, every two sides of a rectangular convolution should extend in a plane perpendicular to the motor axis. In this way one obtains a good adaptation to the shape of the capsule, i.e. to the cover that closes the capsule at the top in the case of a motor compressor having a vertical shaft.

Further, it is recommended that at least one rectilinear tube section extending in a plane perpendicular to the motor axis be longer than the tube sections extending parallel to the motor axis. In this way one achieves a comparatively long tube length with a comparatively smaller extent parallel to the motor axis, i.e. a pressure tube which on the whole is soft in all directions and requires little space.

In a preferred embodiment, it is ensured that at least one first convolution is larger than a second convolution and that the larger convolution is arranged on the side of the motor axis opposite to the cylinder. Since the piston is one of the principal causes of motor oscillations, it is of advantage if the pressure tube spring is softer just in this direction of the cylinder axis.

A space-saving arrangement is also obtained if two sides of a rectangular convolution extend in the direction of the motor axis to both sides of the path of the compensating weight and at least one of these is disposed in the projection of this path.

In order that this pressure tube not only prevents the transmission of low frequencies of oscillation but also dampens higher frequencies, it is recommended that the pressure tube be partially provided with an outer wire coil. In particular, this may be located at the end of the pressure tube adjacent the capsule.

The invention will now be described in more detail with reference to an example illustrated in the drawing, wherein.

Figure 1:
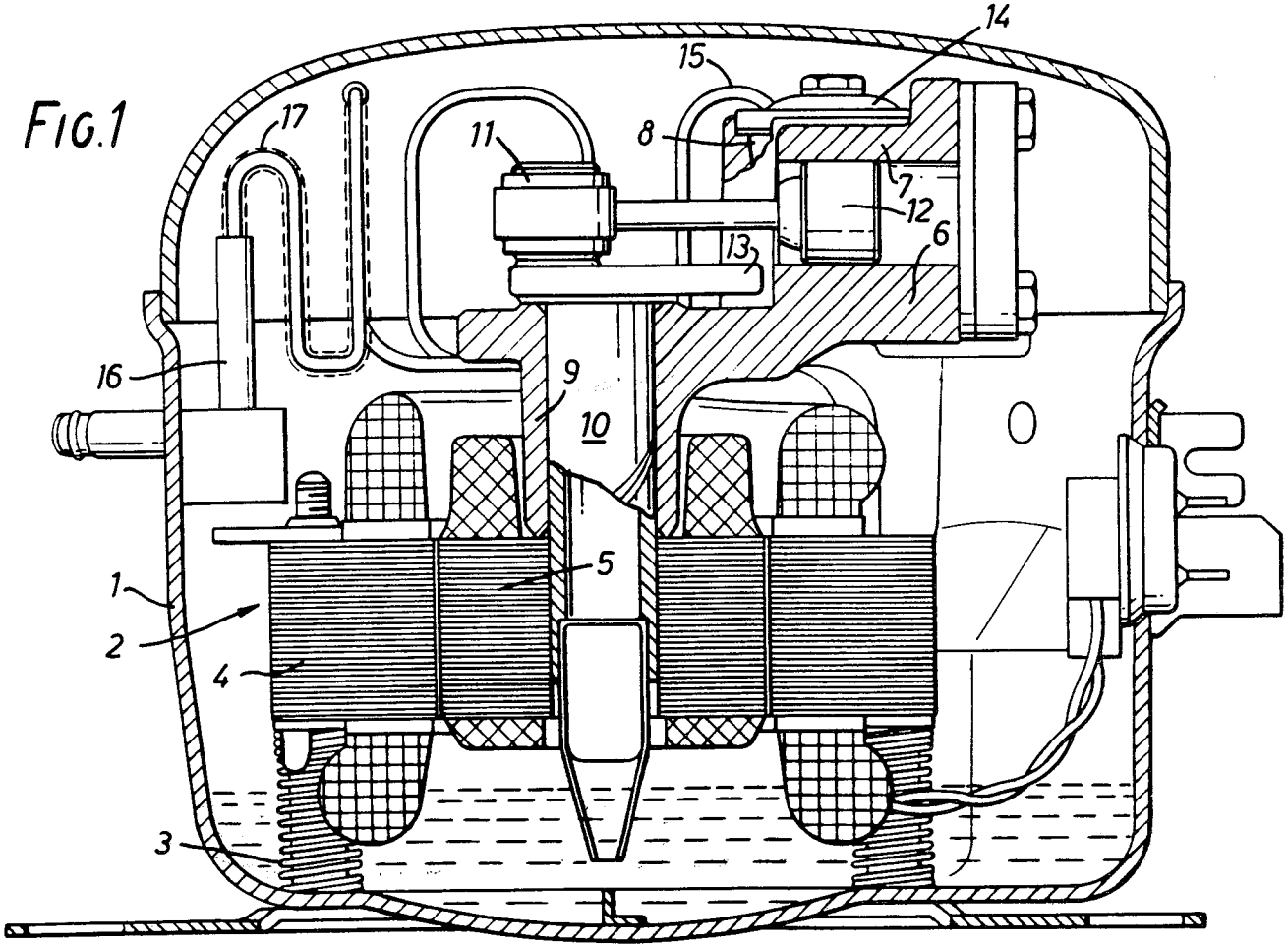
FIG. 1 is a longitudinal section of an encapsulated motor compressor with the pressure tube according to the invention.

In FIG. 1, a motor compressor 2 is supported on springs 3 in a capsule 1. The motor compressor possesses a stator 4 and a rotor 5 as well as a component 6 comprising a cylinder 7, a pressure sound damper 8, a suction sound damper (not shown), and a bearing 9 for a motor crank shaft 10. The latter drives a piston 12 through a crank pin 11. The shaft is further provided with a compensating weight 13. The pressure sound damper 8 comprises a cover 14 from which there projects a pressure tube 15 of which the other end is held in an outlet connection 16. The end of the pressure tube 16 adjacent to this connection is provided with a wire coil 17 which effects damping of higher frequencies.

Figure 2:
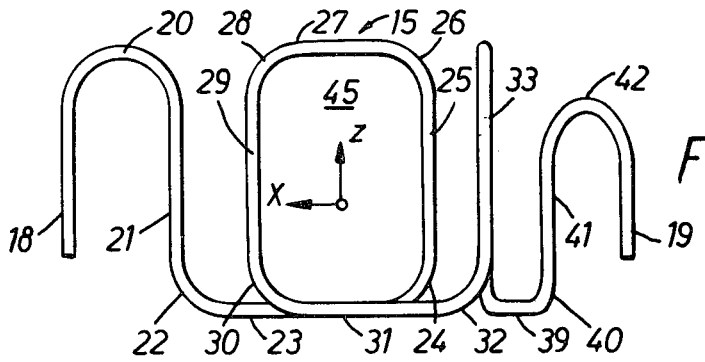
FIG. 2 is an elevation of the pressure tube taken from the back of FIG. 1.
Figure 3:
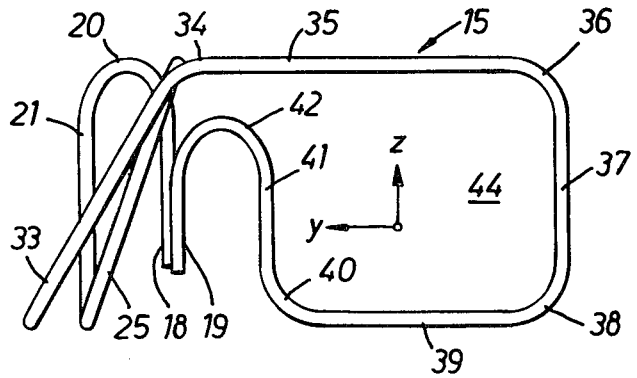
FIG. 3 is an elevation of the pressure tube from the right-hand side of FIG. 2.
Figure 4:
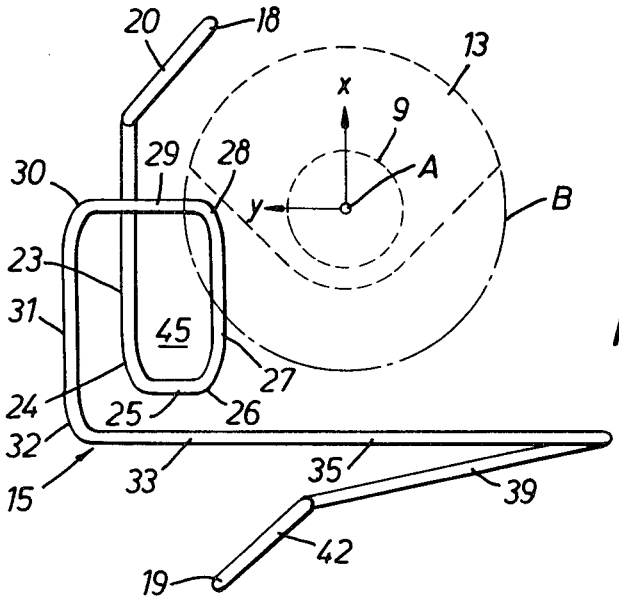
FIG. 4 is a plan view of the pressure tube of FIG. 3.

As shown in FIGS. 2 to 4, the pressure tube 15 has a vertical inlet end 18 and a vertical outlet end 19. Between these there is a 180° curve 20, a vertical section 21, a 90° curve 22, a horizontal section 23, a 90° curve 24, a section 25 inclined 20° to the vertical, a 90° curve 26, a horizontal section 27, a 90° curve 28, a section 29 inclined 30° to the vertical, a 90° curve 30, a horizontal section 31, a 90° curve 32, a section 33 inclined 30° to the vertical, a 120° curve 34, a horizontal section 35, a 90° curve 36, a vertical section 37, a 90° curve 38, a horizontal section 39, a 90° curve 40, a vertical section 41 and a 180° curve 42. FIG. 4 also shows the motor crank shaft 10 with the compensating weight 13 and the motor axis A. The compensating weight 13 follows a circular path B indicated in chain-dotted lines.

The pressure tube sections 35 to 41 form a first larger convolution 44 of which the plane extends substantially parallel to the axis A and which is arranged on the side of this axis opposite to the cylinder 7. The tube sections 23 to 31 form a second smaller convolution 45 of which the plane extends at an angle of between 20 and 30° to the axis A and which, together with the tube sections 21 and 22 as well as 32 and 33 amount to practically 1.75 turns. A portion of this convolution 45 overlaps the path B of the compensating weight 13. The planes of the two loops 44 and 45 are substantially perpendicular to each other.

If one designates the direction of the cylinder axis as $x$, the horizontal direction perpendicular thereto as $y$ and the direction of the motor axis A as $z$, the following manner of operation is obtained. For a component of oscillation in the $x$ direction the sum of the elastic properties of the rectilinear tube sections 21, 25, 29, 33, 35, 37, 39 and 41 is available. Components of oscillations in the $y$ direction are associated with the rectilinear tube sections 21, 23, 25, 27, 29, 31, 33, 37 and 41. Components of the oscillations in the $z$ direction are taken into account by the rectilinear tube sections 23, 25, 27, 29, 31, 33, 35 and 39. Added to these are the albeit reduced elastic properties of the curves. Altogether one therefore obtains a pressure tube spring that is extremely soft in all directions. By appropriate dimensioning, it is possible to give this pressure tube spring the same softness in all directions or to adapt the softness to the respective components of oscillation.

We claim:

1. Refrigeration apparatus comprising a housing having a refrigerant outlet port, a motor and a compressor forming a unit, said unit being resiliently mounted in said housing with the axis of said motor being vertically disposed, a resilient pressure tube extending from said compressor to said outlet port, said tube having at least two adjacent convolutions in intersecting planes which are generally vertically disposed at substantially right angles to each other, said convolutions being substantially rectangular with mostly rectilinear tube sections.

2. Refrigeration apparatus according to claim 1 wherein each plane forms an angle of less than 45 degrees relative to the axis of said motor.

3. Refrigeration apparatus according to claim 1 wherein the plane of at least one of said convolutions is substantially parallel relative to said motor axis.

4. Refrigeration apparatus according to claim 1 wherein the plane of at least one of said convolutions intersects the axis of said motor at an angle between 20° and 30°.

* * * * *